US006382619B1

(12) United States Patent
Gustafson et al.

(10) Patent No.: US 6,382,619 B1
(45) Date of Patent: May 7, 2002

(54) PICK MECHANISM AND IMAGE FORMING DEVICE INCLUDING THE SAME

(75) Inventors: Michael Lee Gustafson; Stephan Walter Emmenegger, both of San Diego; Paul Daniel Faucher, Escondido, all of CA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/552,330

(22) Filed: Apr. 19, 2000

(51) Int. Cl.[7] ..... B65H 3/06
(52) U.S. Cl. ..... 271/117; 271/118
(58) Field of Search ..... 271/9.11, 9.13, 271/117, 118

(56) References Cited

U.S. PATENT DOCUMENTS

| | | | | |
|---|---|---|---|---|
| 3,724,839 A | | 4/1973 | Suzuki | |
| 4,236,709 A | | 12/1980 | Hunt | |
| 4,463,943 A | | 8/1984 | Deconinck | |
| 4,934,686 A | * | 6/1990 | Ono et al. | 271/118 |
| 5,120,042 A | | 6/1992 | Goto et al. | |
| 5,462,267 A | * | 10/1995 | Hori | 271/118 |
| 5,472,183 A | | 12/1995 | Kubo | |
| 5,485,991 A | | 1/1996 | Hirano et al. | |
| 5,527,026 A | | 6/1996 | Padget et al. | |
| 5,624,109 A | * | 4/1997 | Tanaka | 271/118 |
| 5,669,601 A | | 9/1997 | Fisher | |
| 5,678,814 A | | 10/1997 | Yokoyama et al. | |
| 5,709,380 A | * | 1/1998 | Petocchi et al. | 271/117 |
| 5,720,477 A | | 2/1998 | Morita et al. | |
| 5,775,823 A | | 7/1998 | Bekki et al. | |
| 5,868,385 A | | 2/1999 | Embry et al. | |
| 5,931,455 A | * | 8/1999 | Okui et al. | 271/122 |
| 5,988,828 A | | 11/1999 | Mori | |
| 6,168,147 B1 | * | 1/2001 | Nose et al. | 271/118 |

FOREIGN PATENT DOCUMENTS

| | | | |
|---|---|---|---|
| JP | 405301645 | * 10/1993 | 271/117 |
| JP | 406171771 A | * 6/1994 | 271/117 |

OTHER PUBLICATIONS

Towne Et Al., Foam Document Picker, IBM Technical Disclosure Bulletin vol. 13, No. 2 p. 521, Jul. 1970.*

* cited by examiner

*Primary Examiner*—H. Grant Skaggs

(57) ABSTRACT

A pick mechanism including a pick roller, a pick arm supporting the pick roller and an actuation system adapted to move the pick arm from an idle position to a pick position and impart additional normal force to the pick roller. The magnitude of the additional normal force, which is greatest when the tray is full, decreases as the size of the stack in the tray decreases.

32 Claims, 5 Drawing Sheets

PICK MECHANISM AND IMAGE FORMING DEVICE INCLUDING THE SAME

BACKGROUND OF THE INVENTIONS

1. Field of the Inventions

The present inventions are related to image forming devices and, more specifically, to image forming devices having pick mechanisms.

2. Description of the Related Art

An image forming device, such as a printer, copier or facsimile machine, typically includes a feed mechanism that supplies substrates onto which images are formed (referred to generically as "sheets") to the image forming region of the image forming device. Many image forming devices include a tray that stores a stack of sheets. A pick mechanism may be used to pick the top sheet off of the stack and advance the sheet to the feed mechanism.

One type of conventional pick mechanism includes a rotating pick roller that is brought in to and out of engagement with the top of the stack at the appropriate time through use of a pick arm. One end of the pick arm is mounted on a drive shaft that is supported by the chassis of the image forming device. The pick roller is supported on the other end of the pick arm. The pick arm moves between an idle position, where the pick roller is disengaged from stack, and a pick position, where the pick roller engages the top sheet in the stack. The drive shaft also supports a drive shaft gear that drives a series of idler gears on the pick arm which, in turn, drive the pick roller. The pick roller frictionally engages the top sheet and urges the sheet against a stop that is positioned at the front corners or center of the tray. This causes the top sheet to buckle and separate from the remainder of the stack prior to being urged forward to the feed mechanism. One example of such a pick mechanism is illustrated in U.S. Pat. No. 5,527,026.

During the pick process, the magnitude of the normal force exerted onto the pick roller must be maintained within a predefined range so that the pick roller will properly engage the top sheet in the stack. If the magnitude of the normal force is too low, the pick roller will not be able to frictionally engage the top sheet. If the magnitude of the normal force is too great, multiple sheets may be fed and back tension will be created, which can lead to banding and other printer problems. The normal force exerted onto the pick roller in a conventional pick mechanism is equal to the weight of the pick arm plus the force resulting from the torque applied to the pick arm by the drive shaft through the drive shaft gear prior to movement of the top sheet, less any force associate with the counter balance spring in those instances where such a spring is used to bias the pick arm to the idle position.

The inventors herein have determined that one disadvantage associated with this type of conventional pick mechanism is that it can only be effectively used with smaller capacity trays, i.e. about a 100 sheet stack of 20 lb. paper or a stack of other media that is about 10 mm (0.4 inch) in height. In a larger capacity tray, i.e. about a 250 sheet stack of 20 lb. paper or a stack of other media that is about 25 mm (1.0 inch) in height, the normal force on the pick roller is insufficient to properly pick the top sheet from the stack when the tray is full. The reason is as follows.

Regardless of tray capacity, it is preferred that the pick arm move within a range of motion that is typically between about 1 degree (tray full) to about 21 degrees (tray essentially empty) measured from the top of the stack. A pick arm used in conjunction with a larger capacity tray must be longer than that used in conjunction with a smaller capacity tray in order to maintain the 21 degree angle when the larger capacity tray is essentially empty. Increasing the length of the pick arm, however, decreases the magnitude of the normal force imparted on the pick roller by the drive shaft. As a result, the total normal force imparted on the pick roller when the tray is full will be below the level sufficient to properly pick the top sheet from the stack.

One proposed solution to the problems associated with the use of a conventional pick mechanism in combination with a larger capacity tray is to simply increase the weight of the pick arm, thereby increasing the magnitude of the normal force on the pick roller when the tray is full. The present inventors have determined that this proposed solution is unsatisfactory because the additional weight increases the normal force on the pick roller when the tray is close to empty to a level that results in multiple sheet feeds and excessive back tension. Another proposed solution is to increase the size of the drive shaft gear, thereby increasing the torque applied to the pick arm prior to the buckling of the top sheet. The present inventors have determined that this proposed solution undesirably increases the overall size of the pick mechanism.

SUMMARY OF THE INVENTIONS

Accordingly, one object of the present inventions is to provide apparatus that avoids, for practical purposes, the aforementioned problems in the art. In particular, one object of the present inventions is to provide a pick mechanism that may be used in combination a larger capacity tray.

In order to accomplish some of these and other objectives, a pick mechanism in accordance with one embodiment of a present invention includes a pick roller, a pick arm supporting the pick roller and an actuation system adapted to move the pick arm from an idle position to a pick position and impart additional normal force to the pick roller. The magnitude of the normal force, which is greatest when the tray is full, decreases as the size of the stack in the tray decreases. The present pick mechanism therefore allows the pick roller to both frictionally engage the top sheet in a full relatively large tray and function properly when the tray is close to empty. In a preferred embodiment, the additional force will only be applied during the pick process. As such, deformation (or "creep") of the pick arm and other parts will be minimized.

The above described and many other features and attendant advantages of the present inventions will become apparent as the inventions become better understood by reference to the following detailed description when considered in conjunction with the accompanying drawings.

BRIEF DESCRIPTION OF THE DRAWINGS

Detailed description of preferred embodiments of the inventions will be made with reference to the accompanying drawings. Certain aspects of the preferred embodiments have been eliminated from some of the views for clarity.

DETAILED DESCRIPTION OF THE PREFERRED EMBODIMENTS

The following is a detailed description of the best presently known modes of carrying out the inventions. This description is not to be taken in a limiting sense, but is made merely f or the purpose of illustrating the general principles of the inventions. Additionally, it is noted that detailed discussions of various internal operating components of image forming devices which are not pertinent to the present inventions, such as the internal operating components of inkjet printers, have been omitted. for the sake of simplicity.

Figure 1:
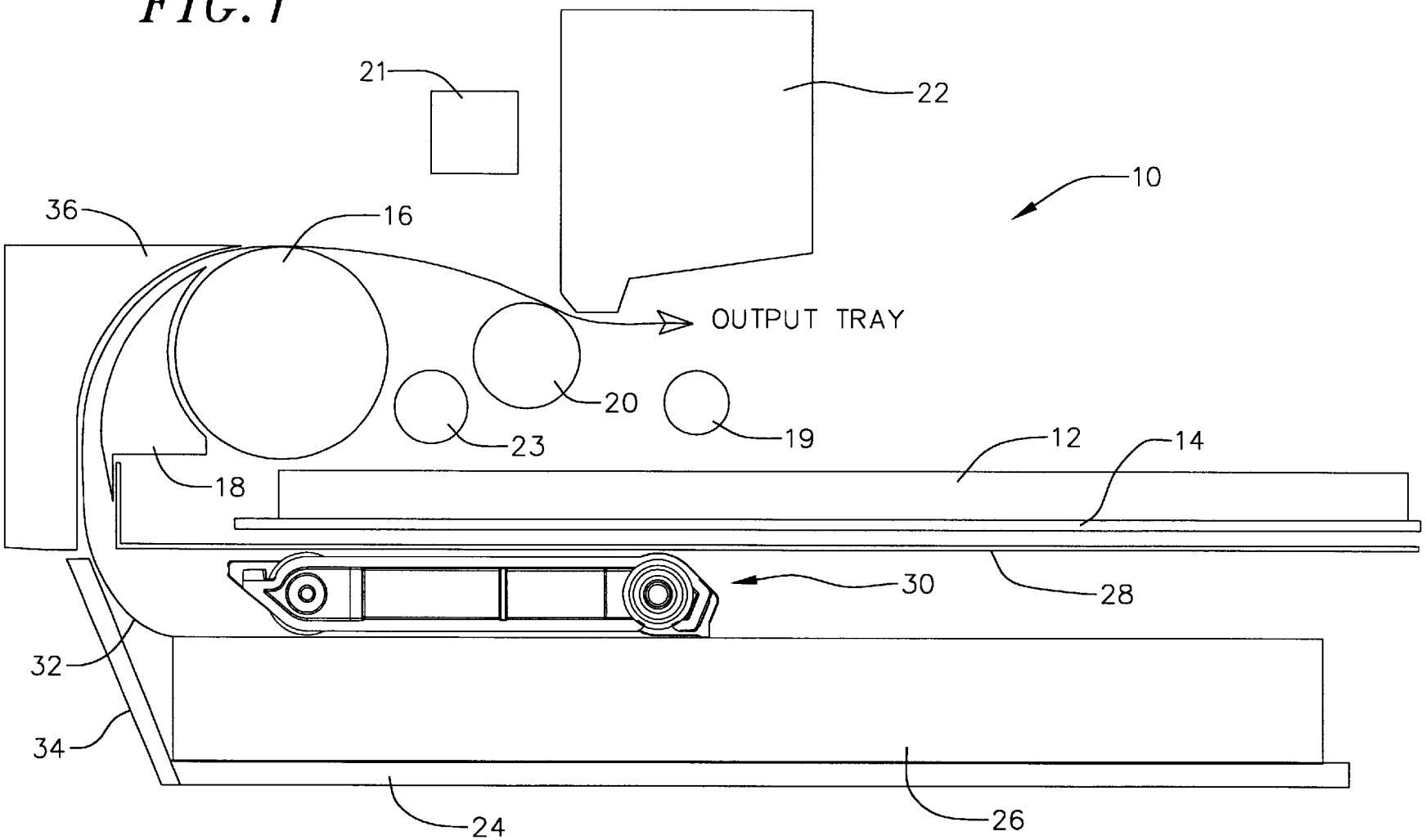
FIG. 1 is a diagrammatic view of a printer in accordance with a preferred embodiment of a present invention.

As illustrated for example in FIG. 1, an image forming device in accordance with one embodiment of a present invention is in the form of an inkjet printer 10 that provides for storage of a sheet stack 12 in an upper tray 14. The sheet stack 12 is brought in to and out of engagement with a pick roller 16 in conventional fashion. For example, the upper tray 14 may be upwardly biased and a cam-like device may be provided to hold the tray in a lower position where the sheet stack is out of engagement with the pick roller 16 when a sheet is not required from the upper tray. A sheet picked from the stack 12 is advanced along a curved deflector 18 and over the pick roller 16 to a feed roller 20. The pick roller 16 and feed roller 20, which are connected to a printer drive shaft (not shown) that is driven by a motor 19 controlled by a controller 21 in conventional fashion, advance the sheet into an image forming region. The drive shaft, pick roller 16, motor 19 and feed roller 20 are operably connected to one another in conventional fashion by a series of gears including, among others, a drive gear 23. An image is formed on the sheet by an inkjet cartridge 22. Once the image is complete, the sheet is advanced by the feed roller 20 to an output tray.

Figure 2:
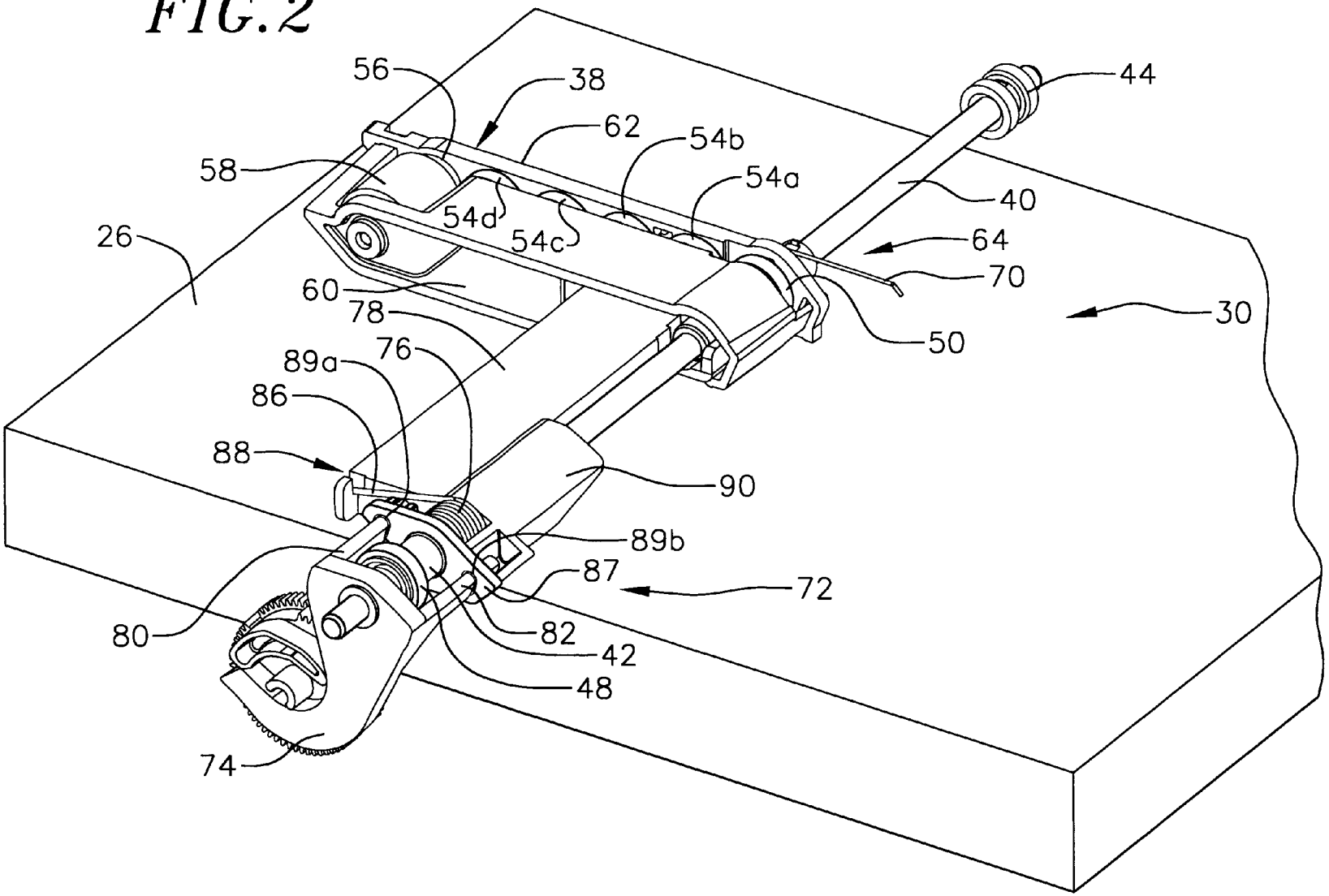
FIG. 2 is a perspective view of a pick mechanism in accordance with a preferred embodiment of a present invention.
Figure 3:
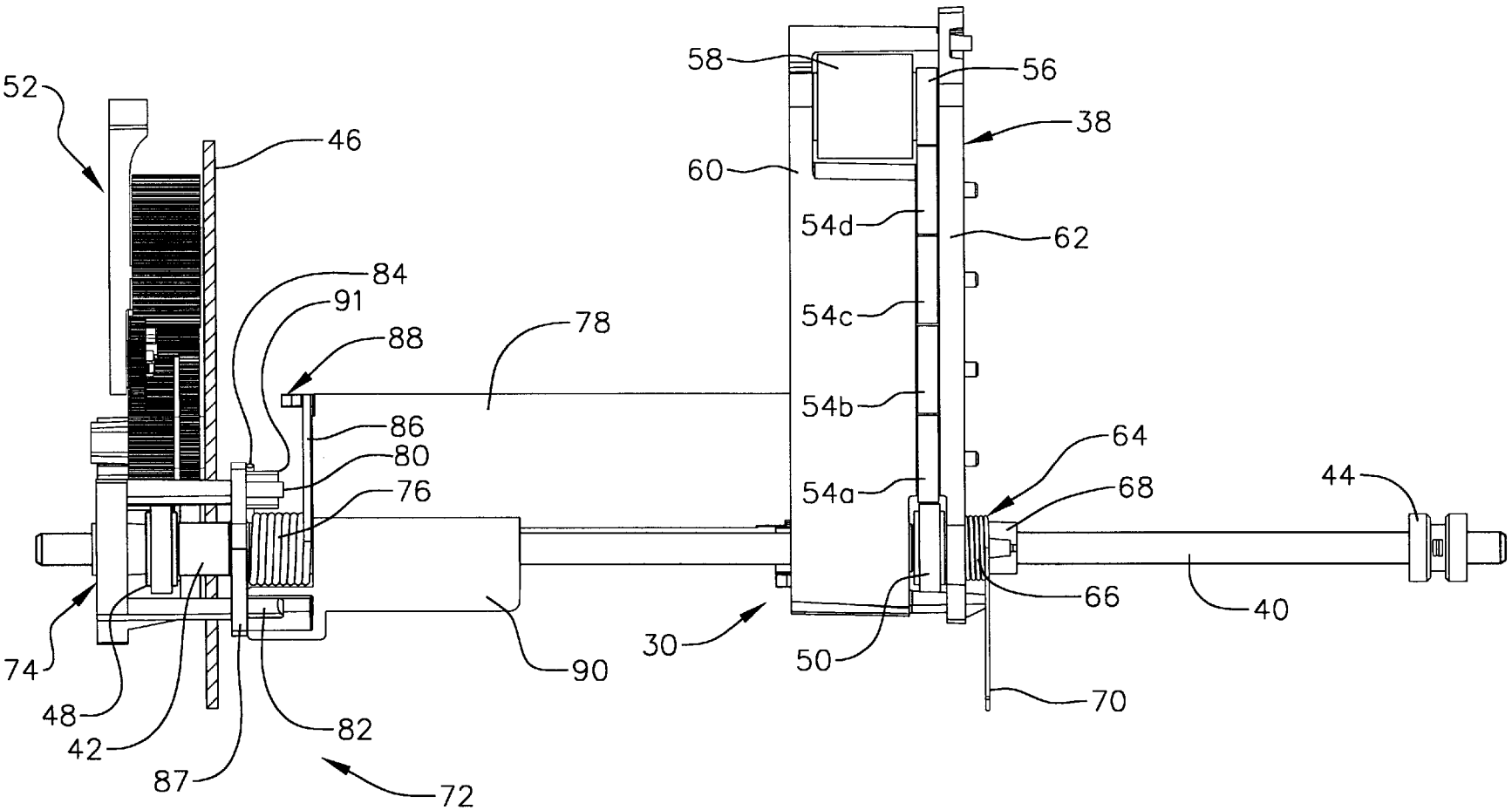
FIG. 3 is a top view of the pick mechanism illustrated in FIG. 2.

The exemplary printer 10 also includes a second, relatively large capacity lower tray 24 for a sheet stack 26. A printer base 28 separates the lower tray 24 from the remainder of the printer 10. A pick mechanism 30, which is discussed in greater detail below with reference to FIGS. 2 and 3, is used to advance the top sheet 32 of the sheet stack 26 into an angled separator wall 34. The separator wall preferably includes a rubber stop. The top sheet 32 will buckle, separate from the rest of the sheet stack 26, and advance along a curved deflector 36 to the pick roller 16. From there, the sheet is advanced to the image forming region and then onto the output tray. The upper sheet stack 12 will, of course, be out of engagement with the pick roller 16 when sheets are being picked from the sheet stack 26.

The deflector 18 and curved deflector 36 are preferably part of a removable cleanout cover which may be removed from the printer to allow the user to clear paper jams. Alternatively, the removable cleanout cover may be replaced by a removable duplexer that, in addition to the duplexer path, defines paper paths similar to those formed by the deflectors 18 and 36.

Turning to FIGS. 2 and 3, the exemplary pick mechanism 30 includes a pick arm 38 that is supported on a rotating drive shaft 40. The drive shaft 40 is supported on a spring hub 42, which acts as a bushing, and a bushing 44. Spring hub 42 is supported on a transmission chassis 46, while bushing 44 is supported on the printer chassis (not shown). The drive shaft 40 also supports drive shaft gears 48 and 50. Drive shaft gear 48 is driven by a transmission system 52 (discussed in detail below with reference to FIGS. 4 and 5) to rotate the drive shaft 40, while drive shaft gear 50 drives a series of pick arm idler gears 54*a*, 54*b*, 54*c* and 54*d*. The pick arm idler gear 54*d* drives a pick roller gear 56 to rotate a pick roller 58. The pick arm idler gears 54*a*–54*d*, pick roller gear 56 and pick roller 58 are secured between a pick arm frame 60 and a pick arm cover 62 to form the pick arm 38.

Alternatively, the pick roller 58 may be driven by a stepper or DC drive motor. Such motors may be mounted on the pick arm or connected directly to the drive shaft 40. Here, a solenoid may be used to drive the actuation lever 74 (described below). Other alternatives includes belt drives, chain drives and bevel gear drives.

In the illustrated embodiment, the pick arm 38 is biased to, and maintained in, an idle position where the pick roller 58 is out of contact with the top sheet in the stack 26 by a counter balance spring 64. The counter balance spring 64 includes a central portion 66, which is supported on a spring hub 68 that is integral with the pick arm cover 62, a first spring arm 70 that engages the underside of the printer base 28, and a second spring arm (not shown) that engages the pick arm 38. Of course, other methods of biasing the pick arm 38, such as a counter weight, solenoid, elastic band, coil spring or leaf spring, may also be employed.

The force of the counter balance spring 68 may be overcome, and the pick arm 38 driven to a pick position where the pick roller 58 engages the top sheet in the stack 26, by a pick mechanism actuation system 72. The actuation system 72 applies force to the pick arm 38 to drive it to the pick position only at the appropriate time (i.e. when a sheet is to be picked). In the preferred embodiment, the force applied by the actuation system 72 will be maximized when the tray 24 is full and the angle between the pick arm 38 and the stack 26 is at its smallest and minimized when the tray is close to empty and the angle between the pick arm and the stack is at its greatest.

There are a number of advantages associated with the present pick mechanism. For example, reducing the magnitude of the normal force added to the pick roller from a maximum when the tray is full to a minimum when the tray is almost empty allows the pick roller to both frictionally engage the top sheet in a full relatively large tray and function properly when the tray is close to empty. Moreover, because the additional force is only applied during the pick process, deformation (or "creep") of the pick arm and related parts will be minimized.

As illustrated in the FIGS. 2 and 3, the exemplary actuation system 72 includes an actuation lever 74, a spring 76 and a bar 78. The actuation lever 74 includes a pair of arms 80 and 82, while the spring 76 includes a pair of arms 84 and 86. The spring hub 42, which supports the spring 76, includes a plate 87 having a pair of slots 89*a* and 89*b* formed therein and an arm rest 91 extending outwardly therefrom. The actuation lever arm 80 extends through the slot 89*a* onto one side of the arm rest 91. Spring arm 84 is located on the other side of the arm rest 91 and spring arm 86 is located within a slot 88 formed in the bar 78. One end of the bar 78 is located within or otherwise secured to the pick arm 38, while the other end of the bar is rotatably supported on the drive shaft 40 by a bar support 90.

The exemplary actuation system 72 and pick arm 38 are shown in the idle state in FIGS. 2 and 3. Here, no additional forces are applied to the pick arm 38. When the actuation lever 74 is rotated by the transmission system 52 to the position illustrated in FIG. 4, the actuation lever arms 80 and 82 will pivot and drive the plate 87, which drives the spring arm 84 which, in turn, rotates the spring 76 and drives the spring arm 86 against the bar 78. A slot 92 (FIG. 4) is formed in the transmission chassis 46 so that the actuation lever arm 80 can move in this manner. A similar slot (not shown) is formed for the actuation lever arm 82.

The force applied to the pick arm 38 by the spring 76 (by way of the bar 78) is more than sufficient to overcome the force applied by the counterbalance spring 64. As a result, the pick arm 38 will be driven to the pick position with the pick roller 58 in contact with the top sheet in the stack 26 and additional normal force will be applied to the pick roller. The spring 76 will unwind as the height of the sheet stack 26 decreases and the angle between the stack and the pick arm 38 increases. Such unwinding decreases the magnitude of the force applied to the bar 78 by the spring 76. Thus, as noted above, the magnitude of the additional normal force will be at a maximum when the tray 24 is full and the pick arm 38 is close to horizontal and at a minimum when the tray 24 is essentially empty.

Figure 4:
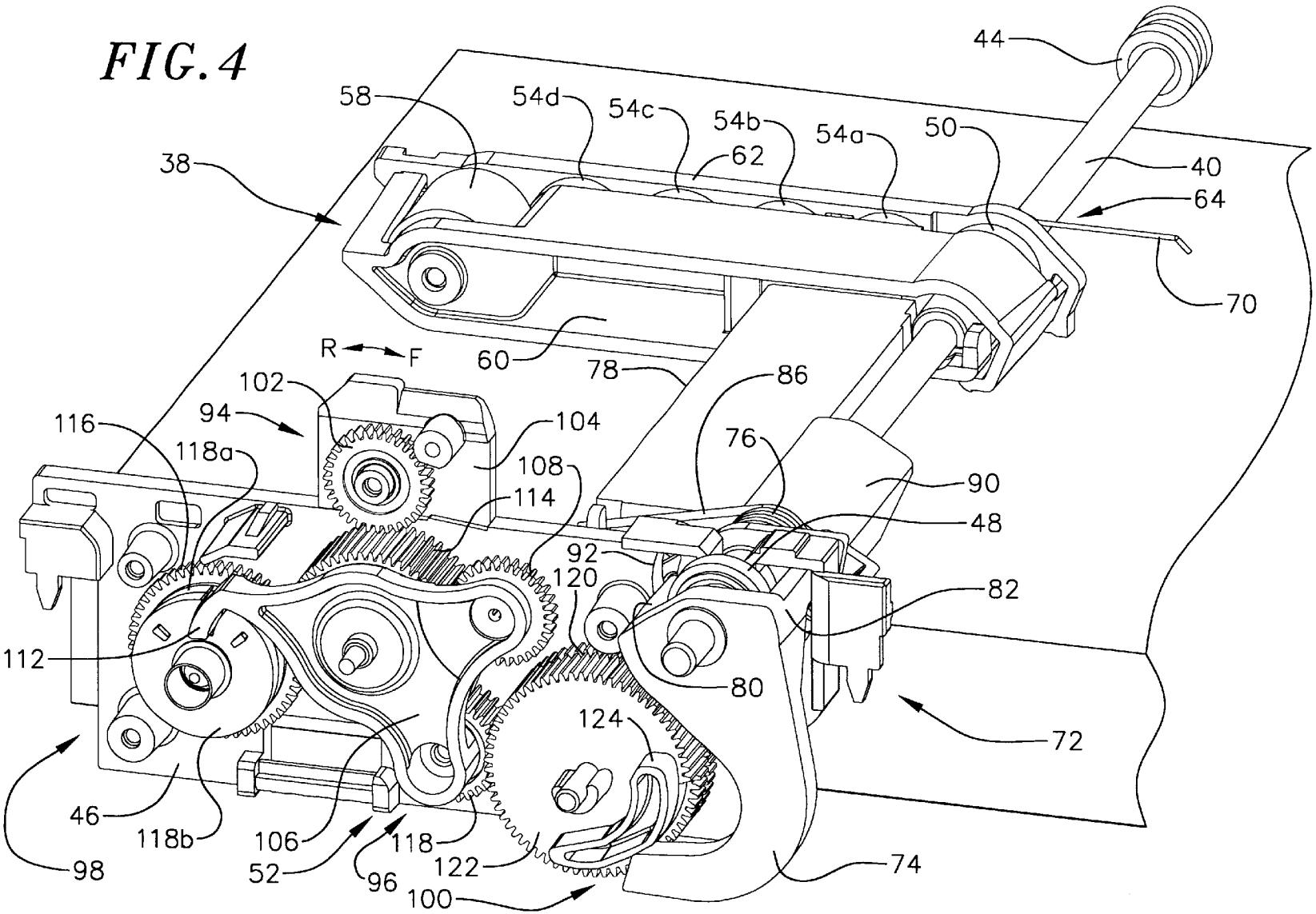
FIG. 4 is a perspective view of the pick mechanism illustrated in FIG. 2 in combination with a transmission system in accordance with a preferred embodiment of a present invention.
Figure 5:
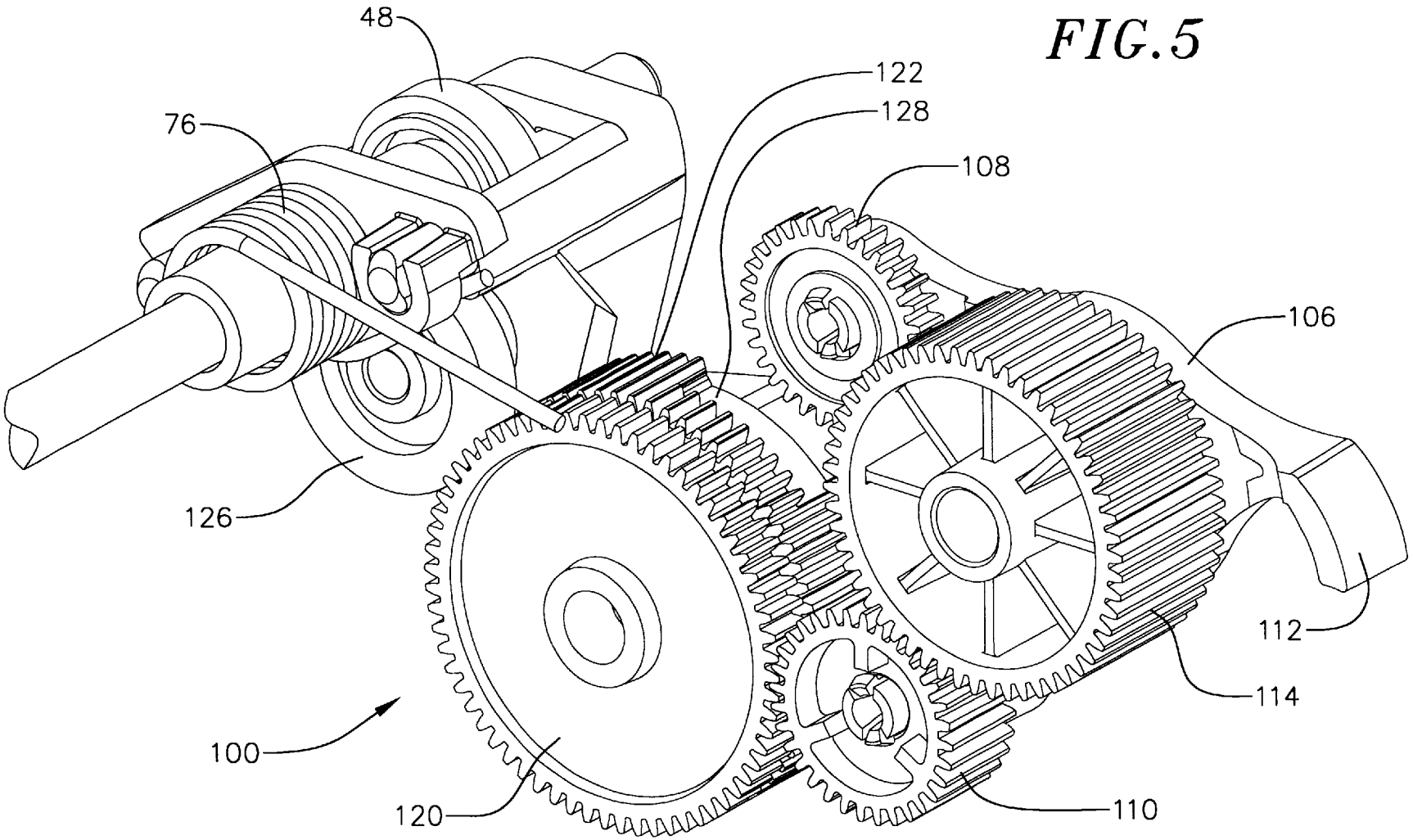
FIG. 5 is a rear perspective view of a portion of the transmission system illustrated in FIG. 4.

The exemplary transmission system 52 illustrated in FIGS. 4 and 5 rotates the drive shaft 40 and pivots the actuation lever 74 at the appropriate times to move the pick arm 38 into the pick position with the pick roller 58 rotating. The exemplary transmission system 52 includes four sub-systems—the input system 94, the lever system 96, the lever lock system 98, and the output system 100. Power from the printer drive shaft is input via the input system 94. Such power is transmitted to the output system 100 via the lever system 96 as controlled by the lever lock system 98. The sub-systems of the exemplary transmission system 52, their components and the operation thereof are discussed below. It should be noted, however, that other transmission systems capable of rotating the drive shaft 40 and pivoting the actuation lever 74 as necessary may also be employed.

The exemplary input system 94 includes an input gear 102 which is mounted on a tab 104 that extends upwardly from the transmission chassis 46, through an opening in the printer base 28, and into the upper portion of the printer 10. The input gear 102, which may be connected to the drive shaft supporting the pick roller 16 by one or more gears, is driven in the forward and reverse directions (clockwise and counterclockwise in the exemplary embodiment) by the printer motor 19. As discussed in greater detail below, the printer initiates a pick with the pick mechanism 30 by briefly shifting the motor 19 into reverse.

Turning to the lever system 96, the system includes a lever arm 106 that supports a pair of lever gears 108 and 110. The lever arm 106, which includes a tab 112, is frictionally engaged by a lever gear 114. The lever gear 114 is driven by input gear 102 and, in turn, drives the lever gears 108 and 110 and pivots the lever arm 106 in the manner described below.

The exemplary lever lock system 98 includes a lock gear 116, which is driven by the lever gear 114, and first and second lock disks 118*a* and 118*b*. The lock disks 118*a* and 118*b* are provided with slots which, when aligned in the manner illustrated in FIG. 4, will receive the lever arm tab 112. The first lock disk 118*a* is frictionally engaged by the lock gear 116 and the second lock disk 118*b* is driven by the first lock disk. To that end, the lock disks 118*a* and 118*b* may be spring loaded with a friction washer in between in a manner similar to the construction of the tumblers in a conventional combination lock. In addition, the facing surfaces of the lock disks 118*a* and 118*b* include tabs that engage one and other at certain rotational points to insure proper alignment of the slots. Rotation of the lock disks 118*a* and 118*b* is limited in either direction by stops (not shown). The stops set the rotational orientation of the lock disks 118*a* and 118*b* to their initial, pre-pick positions (slots misaligned) while the printer motor 19 is driving the input gear 102 in the forward direction and in their pick positions (slots aligned below the lever arm tab 112) when the printer motor is driving the input gear a preset distance in reverse.

More specifically, the first lock disk 118*a* in the exemplary embodiment will be rotated a preset distance when the motor 19 is in reverse. The first lock disk 118*a* will engage the second lock disk 118*b* and the stop. At this point, there will be a slight offset of the slots relative to one another and to the lever arm tab 112. The slots and lever arm tab 112 will align with one another upon the initial forward movement of the motor 19, which also causes the lever arm tab to be driven into the aligned slots.

The exemplary output system 100 illustrated in FIGS. 4 and 5 includes an idler gear 120, a cam gear 122 that supports a cam 124, and a step gear 126. Both the idler gear 120 and the cam gear 122 are driven by the lever gear 114. Rotation of the idler gear 120 drives the step gear 126 which, in turn, drives the shaft gear 48. Rotation of the cam gear 122 causes the cam 124 to drive the actuation lever 74 from the idle position illustrated in FIG. 2 to the pick position illustrated in FIG. 4. The cam gear 122 includes an outer no-teeth zone 128 and an inner no-teeth zone of equal width and slightly shorter length (not shown). The no-teeth zones are used to control rotation of the cam gear 122 in the manner described below.

The exemplary transmission device 52 operates as follows. The printer motor 19, which typically drives the input gear 102 in the forward direction, is shifted into reverse to shift the transmission device into its pick state and start the pick process. The lever gear 114 applies rotational force to the lever arm 106 and also rotates the lock gear 116. Rotation of the lock gear 116 causes the lock disks 118*a* and 118*b* to rotate until their slots are slightly misaligned with one another and with the lever arm tab 112. The direction of the motor 19 will then be switched back to forward. The slots then align and the lever arm tab 112 then drops into the slots, thereby causing the lever arm 106 to rotate into the pick position. The lever arm gear 110, which is being driven by the lever gear 114, will then engage the idler gear 120 and cam gear 122.

As noted above, rotation of the idler gear 120 will drive the step gear 126, which drives the shaft gear 48, thereby causing the shaft 40 to rotate and drive the shaft gear 50 and, ultimately, the pick roller 58. Rotation of the cam gear 122, which causes the cam 124 to pivot the actuation lever 74 such that the pick roller 58 engages the top sheet in the stack 26, will continue until the inner no-teeth zone reaches the lever arm gear 110. Although rotation of the cam gear 122 will cease, the idler gear 120 will continue to rotate. As a result, the pick roller 58 will continue to rotate and drive the top sheet from the stack 26.

The sheet will be sensed by a sensor (not shown) when it reaches a predetermined point at or beyond the pick roller 16. Once this takes place, and prior to the sheet reaching the inkjet cartridge 22, the motor 19 will briefly reverse direction to shift the transmission back to the idle state. The input gear 102 will drive the lever gear 114 in reverse, which causes the lever arm 106 to pivot such that the lever arm tab 112 is pulled out of the slots in the lock disks 118*a* and 118*b*. This causes the lever arm gear 110 to disengage from the idler gear 120 to end rotation of the drive shaft 40. The lever gear 114 also drives lock gear 116 in reverse, thereby causing the lock disks 118*a* and 118*b* to rotate back to their pre-pick positions with the slots misaligned.

The printer motor 19 then shifts back into forward.

The lever arm gear 108, which is being driven by the lever gear 114, will engage the cam gear 122 and drive the cam gear until the cam 124, actuation lever 74 and pick arm 38 return to their respective idle positions (FIG. 2) and the outer no-teeth zone 128 reaches lever arm gear 108 to end rotation of the cam gear.

The printer motor 19 will continue to drive the sheet forward through the print zone and complete the image formation process. However, forward rotation of the input gear 102, which is attendant to the printing process, will not effect the transmission system 52 in the idle state because (1) the lock gear 116 will simply continue to rotate after the lock disks 118*a* and 118*b* reach their initial, pre-pick positions, (2) the misalignment of lever arm tab 112 and the lock disk slots will prevent the lever arm gear 110 from engaging the idler gear 120 and cam gear 122, and (3) the lever arm gear 108 is aligned with the outer no-teeth zone 128. The transmission system will remain in the idle state until the motor 19 is again reversed for the preset distance.

Although the present inventions have been described in terms of the preferred embodiments above, numerous modifications and/or additions to the above-described preferred embodiments would be readily apparent to one skilled in the art. It is intended that the scope of the present inventions extend to all such modifications and/or additions.

We claim:

1. A pick mechanism for picking a sheet from a stack, the pick mechanism comprising:

a pick roller;

a pick arm supporting the pick roller, the pick arm being pivotably supported adjacent the stack and movable about an axis of rotation between an idle position, a first pick position wherein the pick arm and the stack define a minimum angle therebetween and a second pick position where the pick arm and the stack define a maximum angle therebetween; and an actuation system that moves the pick arm from the idle position to the pick positions, imparts a first force to the pick arm that creates a first torque about the axis of rotation when the pick arm is in the first pick position, and imparts a second force to the pick arm that creates a second torque about the axis of rotation when the pick arm is in the second pick position, the second torque being less than the first torque.

2. A pick mechanism as claimed in claim 1, wherein the pick arm includes a pick roller gear, the pick mechanism further comprising:

a drive shaft supporting the pick arm and a drive shaft gear on the drive shaft operably connected to the pick roller gear.

3. A pick mechanism as claimed in claim 1, wherein the actuation system comprises a resilient member that applies force to the pick arm.

4. A pick mechanism as claimed in claim 3, wherein the resilient member is connected to the pick arm by a bar.

5. A pick mechanism as claimed in claim 3, wherein the resilient member is movable between an idle orientation where substantially no force is applied to the pick arm by the resilient member and a pick orientation where force is applied to the pick arm by the resilient member, the pick mechanism further comprising:

an actuator adapted to rotate the resilient member from the idle orientation to the pick orientation.

6. A pick mechanism for picking a sheet from a stack, the pick mechanism comprising:

a pick roller;

a pick arm supporting the pick roller, the pick arm being pivotably supported adjacent the stack and movable between an idle position, a first pick position wherein the pick arm and the stack define a minimum angle therebetween and a second pick position where the pick arm and the stack define a maximum angle therebetween;

an actuation system adapted to move the pick arm from the idle position, impart a first normal force to the pick roller when the pick arm is in the first pick position and a second normal force when the pick arm is in the second pick position, the actuation system including a resilient member that applies force to the pick arm, movable between an idle orientation where substantially no force is applied to the pick arm by the resilient member and a pick orientation where force is applied to the pick arm by the resilient member, and having a main body, a first arm and a second arm, the second arm being operably connected to the pick arm; and an actuator operably connected to the first arm adapted to rotate the resilient member from the idle orientation to the pick orientation.

7. A pick mechanism for picking a sheet from a stack, the pick mechanism comprising:

a pick roller;

a pick arm supporting the pick roller, the pick arm being pivotably supported adjacent the stack and movable between an idle position, a first pick position wherein the pick arm and the stack define a minimum angle therebetween and a second pick position where the pick arm and the stack define a maximum angle therebetween;

an actuation system adapted to move the pick arm from the idle position, impart a first normal force to the pick roller when the pick arm is in the first pick position and a second normal force when the pick arm is in the second pick position, the actuation system including a resilient member that applies force to the pick arm and is movable between an idle orientation where substantially no force is applied to the pick arm by the resilient member and a pick orientation where force is applied to the pick arm by the resilient member; and an actuator, including a lever and cam arrangement, adapted to rotate the resilient member from the idle orientation to the pick orientation.

8. An apparatus, comprising:

an image formation device;

a sheet storage device adapted to store a stack of sheets; and a pick mechanism for advance a sheet from the storage device toward the image formation device including a pick roller, a pick arm supporting the pick roller, the pick arm being pivotably supported adjacent the stack and movable about an axis of rotation between an idle position, a first pick position wherein the pick arm and the stack define a minimum angle therebetween and a second pick position where the pick arm and the stack define a maximum angle therebetween, and an actuation system that moves the pick arm from the idle position to the pick positions, imparts a first force to the pick arm that creates a first torque about the axis of rotation when the pick arm is in the first pick position, and imparts a second force to the pick arm that creates a second torque about the axis of rotation when the pick arm is in the second pick position, the second torque being less than the first torque.

9. An apparatus as claimed in claim 8, wherein the pick arm includes a pick roller gear, the pick mechanism further comprising:

a drive shaft supporting the pick arm and a drive shaft gear on the drive shaft operably connected to the pick roller gear.

10. An apparatus as claimed in claim 8, wherein the actuation system comprises a resilient member that applies force to the pick arm.

11. An apparatus as claimed in claim 10, wherein the resilient member is connected to the pick arm by a bar.

12. An apparatus as claimed in claim 10, wherein the resilient member is movable between an idle orientation where substantially no force is applied to the pick arm by the resilient member and a pick orientation where force is applied to the pick arm by the resilient member, the pick mechanism further comprising:

an actuator adapted to rotate the resilient member from the idle orientation to the pick orientation.

13. An apparatus as claimed in claim 8, wherein the sheet storage device defines a first sheet storage device, the apparatus further comprising:

a second sheet storage device.

14. An apparatus as claimed in claim 13, wherein the pick roller defines a first pick roller, the apparatus further comprising:

a second pick roller associated with the second sheet storage device.

15. An apparatus, comprising:

an image formation device;

a sheet storage device adapted to store a stack of sheets; and a pick mechanism for advance a sheet from the storage device toward the image formation device including a pick roller, a pick arm supporting the pick roller, the pick arm being pivotably supported adjacent the stack and movable between an idle position, a first pick position wherein the pick arm and the stack define a minimum angle therebetween and a second pick position where the pick arm and the stack define a maximum angle therebetween, an actuation system adapted to move the pick arm from the idle position, impart a first normal force to the pick roller when the pick arm is in the first pick position and a second normal force when the pick arm is in the second pick position, the actuation system including a resilient member that applies force to the pick arm, movable between an idle orientation where substantially no force is applied to the pick arm by the resilient member and a pick orientation where force is applied to the pick arm by the resilient member, and having a main body, a first arm and a second arm, the second arm being operably connected to the pick arm; and an actuator operably connected to the first arm adapted to rotate the resilient member from the idle orientation to the pick orientation.

16. An apparatus, comprising:

an image formation device;

a sheet storage device adapted to store a stack of sheets; and a pick mechanism for advance a sheet from the storage device toward the image formation device including a pick roller, a pick arm supporting the pick roller, the pick arm being pivotably supported adjacent the stack and movable between an idle position, a first pick position wherein the pick arm and the stack define a minimum angle therebetween and a second pick position where the pick arm and the stack define a maximum angle therebetween, an actuation system adapted to move the pick arm from the idle position, impart a first normal force to the pick roller when the pick arm is in the first pick position and a second normal force when the pick arm is in the second pick position, the actuation system including a resilient member that applies force to the pick arm and is movable between an idle orientation where substantially no force is applied to the pick arm by the resilient member and a pick orientation where force is applied to the pick arm by the resilient member; and an actuator, including a lever and cam arrangement, adapted to rotate the resilient member from the idle orientation to the pick orientation.

17. A pick mechanism for picking a sheet from a stack, the pick mechanism comprising:

a pick arm, including a pick roller that rotates about a roller axis, pivotably supported adjacent the stack and movable about an arm axis between an idle position, a first pick position in contact with the stack where the pick arm and the stack define a minimum angle therebetween, and a second pick position in contact with the stack where the pick arm and the stack define a maximum angle therebetween;

a drive apparatus that rotates the pick roller; and an actuation system that moves the pick arm from the idle position to the pick positions, imparts a first force to the pick arm that creates a first torque about the arm axis when the pick arm is in the first pick position, and imparts a second force to the pick arm that creates a second torque about the arm axis when the pick arm is in the second pick position, the second torque being less than the first torque.

18. A pick mechanism as claimed in claim 17, further comprising:

a rotating drive shaft;

wherein the drive apparatus transfers rotational motion of the drive shaft to the pick roller.

19. A pick mechanism as claimed in claim 18, wherein the drive apparatus comprises a plurality of gears, at least one of the gears being associated with the drive shaft and at least one of the gears being associated with the pick roller.

20. A pick mechanism as claimed in claim 17, wherein the actuation system comprises a spring.

21. A pick mechanism as claimed in claim 20, wherein the spring is wound less tightly at the second pick position than at the first pick position.

22. A pick mechanism as claimed in claim 17, wherein the pick arm is movable between a plurality of pick positions between the first pick position and the second pick position, the actuation system imparts force to the pick arm at each of the plurality of pick positions that creates a plurality of different torques about the arm axis.

23. A pick mechanism as claimed in claim 22, wherein the plurality of different torques sequentially decrease as the pick arm moves toward the second pick position.

24. A pick mechanism as claimed in claim 17, wherein at least a portion of the actuation system is formed from structural elements that are not part of the drive apparatus.

25. An apparatus, comprising:

an image formation device;

a sheet storage device adapted to store a stack of sheets; and a pick mechanism for advance a sheet from the storage device toward the image formation device including a pick arm, including a pick roller that rotates about a roller axis, pivotably supported adjacent the stack and movable about an arm axis between an idle position, a first pick position in contact with the stack where the pick arm and the stack define a minimum angle therebetween, and a second pick position in contact with the stack where the pick arm and the stack define a maximum angle therebetween, a drive apparatus that rotates the pick roller, and an actuation system that moves the pick arm from the idle position to the pick positions, imparts a first force to the pick arm that creates a first torque about the arm axis when the pick arm is in the first pick position, and imparts a second force to the pick arm that creates a second torque about the arm axis when the pick arm is in the second pick position, the second torque being less than the first torque.

26. An apparatus as claimed in claim 25, further comprising:

a rotating drive shaft;

wherein the drive apparatus transfers rotational motion of the drive shaft to the pick roller.

27. An apparatus as claimed in claim 26, wherein the drive apparatus comprises a plurality of gears, at least one of the gears being associated with the drive shaft and at least one of the gears being associated with the pick roller.

28. An apparatus as claimed in claim 25, wherein the actuation system comprises a spring.

29. An apparatus as claimed in claim 28, wherein the spring is wound less tightly at the second pick position than at the first pick position.

30. An apparatus as claimed in claim 25, wherein the pick arm is movable between a plurality of pick positions between the first pick position and the second pick position, the actuation system imparts force to the pick arm at each of the plurality of pick positions that creates a plurality of different torques about the arm axis.

31. An apparatus as claimed in claim 30, wherein the plurality of different torques sequentially decrease as the pick arm moves toward the second pick position.

32. An apparatus as claimed in claim 25, wherein at least a portion of the actuation system is formed from structural elements that are not part of the drive apparatus.

* * * * *

UNITED STATES PATENT AND TRADEMARK OFFICE

CERTIFICATE OF CORRECTION

PATENT NO. : 6,382,619 B1
DATED : May 7, 2002
INVENTOR(S) : Gustafson et al.

It is certified that error appears in the above-identified patent and that said Letters Patent is hereby corrected as shown below:

Column 8,
Line 58, “advance” should read -- advancing --.

Signed and Sealed this

Eleventh Day of February, 2003

JAMES E. ROGAN
*Director of the United States Patent and Trademark Office*